United States Patent [19]

Miller et al.

[11] 4,193,704

[45] Mar. 18, 1980

[54] FASTENER FOR WIRE BOUND MEDIA

[75] Inventors: Scott Miller, Stratford, Conn.; Thomas Bushman, Dover, Mass.; Kurt Kruger, Monroe; Kenneth Van Dyck, Westport, both of Conn.

[73] Assignee: Dennison Manufacturing Company, Framingham, Mass.

[21] Appl. No.: 935,208

[22] Filed: Aug. 21, 1978

[51] Int. Cl.[2] ..... B42F 3/06

[52] U.S. Cl. ..... 402/19; 402/57; 402/500

[58] Field of Search ..... 402/12, 19, 57, 500, 402/501

[56] References Cited

U.S. PATENT DOCUMENTS

| | | | |
|---|---|---|---|
| 717,957 | 1/1903 | Weaver | 402/501 X |
| 1,107,351 | 8/1914 | Proudfit | 402/501 X |
| 1,222,881 | 4/1917 | McCullough | 402/19 |
| 2,232,058 | 2/1941 | Farkas et al. | 402/19 |
| 2,848,163 | 8/1958 | Serrell | 402/501 X |
| 3,270,874 | 9/1966 | Hilton | 40/2 UX |
| 3,315,683 | 4/1967 | Rodriguez et al. | 402/500 X |
| 3,899,842 | 8/1975 | Schneider | 402/501 X |

FOREIGN PATENT DOCUMENTS

| | | | |
|---|---|---|---|
| 200778 | 1/1966 | Sweden | 402/501 |
| 643124 | 9/1950 | United Kingdom | 402/500 |

*Primary Examiner*—Paul A. Bell

*Attorney, Agent, or Firm*—George E. Kersey

[57] ABSTRACT

A fastener to permit the capture and release by a selected medium of the wire binder on notebooks, tablets, or the like. The fastener includes a series of tabs which are profiled so that the captured medium resists removal due to ordinary stresses, but may be inserted and removed by means of an easily applied transverse force.

21 Claims, 11 Drawing Figures

FASTENER FOR WIRE BOUND MEDIA

BACKGROUND OF THE INVENTION

The present invention relates to fasteners, and more particularly, to fasteners for wire-bound media.

Wire-bound notebooks, tablets, and the like are traditionally merchandised with a pre-attached medium, typically sheets of paper. The wire binder normally takes the form of a spiral or helix, and binds the selected medium by insertion through apertures in the edge of each sheet or specimen. The sheets are secured to the wire binder so as to make accidental separation from the binder unlikely.

The wire binding of selected media, while reducing the danger of accidental separation, suffers several disadvantages. The specimens are bound in such a way that their insertion for the purpose of editing, or of adding a different medium, is impracticable. In the usual arrangement, furthermore, specimens may not be reinserted once separated from the wire binder. Moreover, the aggregate number of sheets or specimens is limited to that chosen by the manufacturer.

One approach to this problem is illustrated by the index sheet for coil wire binders of F. S. Schade, U.S. Pat. No. 2,681,655. Schade discloses the use of an extended portion of an index sheet, containing slots for registration with the spiral wire coils. A retaining rod is inserted in the pocket formed by folding the extended portion, with the rod inside the spiral to engage the coils. The insertion and removal of specimens using this fastener can be a fairly cumbersome and time consuming process. These fasteners must also be manufactured in a different version for each different coil pitch (number of coils per inch).

An alternate approach which avoids the complexity of the above fastener involves a series of apertures on a fastener or specimen to be engaged. These apertures should be profiled to firmly engage the wire coils while permitting insertion and removal without undue effort. While this approach has never been applied to spiral binders per se, M. G. Swan discloses a detachable leaf for books bound by staples, using the same concept, in U.S. Pat. No. 818,130. Swan's apertures are L-shaped, not all facing in the same direction, and the pages are inserted and removed by bending the portion containing the contrarily-facing L slot. This technique would not be advantageously extended to a multiplicity of L slots for the numerous coils of a wire binder. A. H. Schneider, in U.S. Pat. No. 3,899,842, teaches a card supporting means for a rotary card file involving two key slots which engage two metal rings. The key slots face in a direction transverse to the direction of insertion and removal of the cards. This technique, again, cannot be used to engage a multiplicity of wire coils requiring more than two points of attachment.

Accordingly, it is a principal object of the invention to facilitate the insertion of specimens of any selected medium into the wire binder of a notebook, tablet, or the like. A related object is to permit augmentation of a wire-bound medium chosen by a manufacturer with additional specimens of the same or of a different medium.

Another related object is to achieve easy reinsertion into a wire binder of specimens which have been removed.

A further object of the invention is to employ a fastener for the above purposes which allows separation of a selected medium while preserving the utility of the fastener for subsequent reattachment. A related object is to permit editing of wire-bound media.

Yet another object of the invention is that such a fastener should not be unduly complex. Insertion and removal of specimens using the fastener should be quickly and easily accomplished, yet the fastener should firmly engage the wire coils.

SUMMARY OF THE INVENTION

In accomplishing the above and related objects, the fastener of the invention for spiral binders includes a tab and a backing member attached to a base. The tab and backing member define an interior aperture, and are separated by a gap, such that a wire coil may be admitted through the gap and captured by the aperture.

In accordance with one aspect of the invention, the tab includes a hooked region bordering the gap which frustrates the release of a captured wire coil. The fastener is composed of a material which resists distortion in the fastener plane, but which is readily flexed in a transverse direction. In accordance with a related aspect of the invention, the gap is of a width which does not permit the passage of a wire coil when the fastener is undistorted. By bending the hooked region of a tab, the gap is widened to allow passage of the coil.

In accordance with another aspect of the invention, the location of the gap and the size of the hooked region may be varied to alter the effort required to capture and release a wire coil. The aperture is advantageously a circle of a diameter comparable to the holes in the edges of conventional wire bound sheets. In a preferred embodiment, the orientation of the gap is tangential to the perimeter of the aperture.

In accordance with a further aspect of the invention, fasteners of the above type may be compounded in a linear array to create a fastener row for engaging a spiral binder. In a particular embodiment, a series of fasteners are spaced at intervals matching the separation of individual coils in a binder of a given coil pitch. In this embodiment, a portion of each tab serves as a backing member for an adjacent tab. In an alternative embodiment, a series of tab-backing member pairs are spaced at intervals of 1 inch, so as to be compatible with a number of coil pitches. Optionally, in this embodiment, the relative positions of corresponding tabs and backing members may be alternated from pair to pair. This arrangement minimizes the danger of accidental separation of the fastener row in response to an outward, angled force.

In accordance with one format of the above fastener, a fastener row is appended to a marginal strip for attaching specimens to a spiral binder. The marginal strip may be coated with adhesive on one or both sides. A fastener strip of this description may come alone or with preattached specimens. In another format, a fastener row is perforated in the edge of a specimen to be carried by a wire binder. The fastener row may be reinforced by coating it with a material such as plastic.

BRIEF DESCRIPTION OF THE DRAWINGS

The above and additional aspects and embodiments of the invention are explained in the detailed description which follows, taken together with the drawings in which.

DETAILED DESCRIPTION

Figure 1:
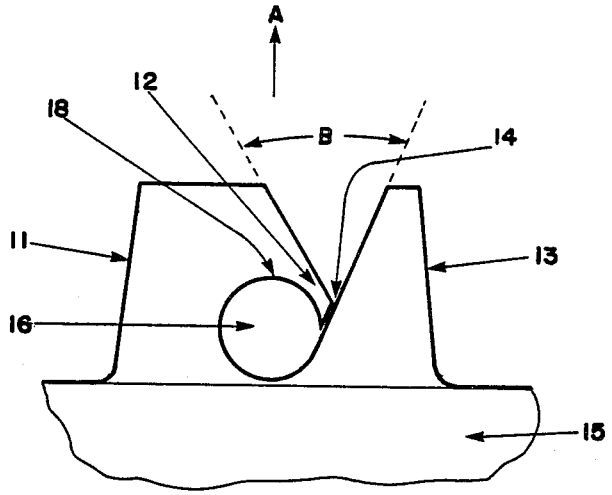
FIG. 1 is a plan view of a fastener tab and backing member in accordance with a particular embodiment of the invention.

Reference should now be had to FIGS. 1 through 9 for a detailed description of the fastener of the invention for spiral binders. A fastener 10 in accordance with one embodiment of the invention is shown in FIG. 1. A tab 11 and a backing member 13 are attached to a base 15. Tab 11 and backing member 13 are profiled so as to define an aperture 16, which is advantageously circular and similar in diameter to the holes in the edge of sheets which are conventionally bound in spiral notebooks (i.e. approximately 0.125 inch).

Tab 11 is further characterized by a hooked region 12, which prevents a coil (not shown) which is inserted into aperture 16 from escaping when subjected to a force in direction A, as hooked region 12 resists distortion in that direction. Hooked region 12 and backing member 13 define a gap 14 through which a coil passes during insertion into or removal from aperture 16. The width of gap 14 is such that, when the tab 11 is not flexed or distorted, the gap will not allow passage of a wire coil.

Figure 2:
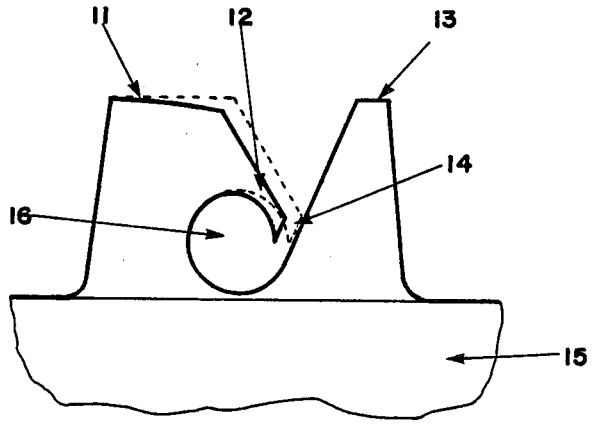
FIG. 2 is a perspective view of the fastener of FIG. 1, distorted to allow passage of a wire coil.

Attachment and removal of fastener 10 to and from a wire spiral is accomplished by the transverse bending of tab 11, as illustrated in the perspective view FIG. 2. In contrast to the resistance of tab 11 to distortion within the plane of fastener 10, it is quite amenable to bending or curling of its outer portions, including the hooked region 12, out of this plane. By means of the curling of the hooked region 12, as shown in FIG. 2, the gap 14 is widened so as to allow insertion of a wire spiral coil (not shown) into aperture 16.

It is desirable to choose a material for the fastener of the invention which will behave as shown in FIG. 2 when subjected to forces in and out of the plane of the fasteners. Another criterion is that the material resist stretching, tearing and fraying, to ensure that the fastener may be repeatedly inserted into and removed from a spiral binder. Suitable materials include plastics such as polyethylene, polypropylene, acetate, and the plastic films sold under the trademark Mylar.

Figure 3:
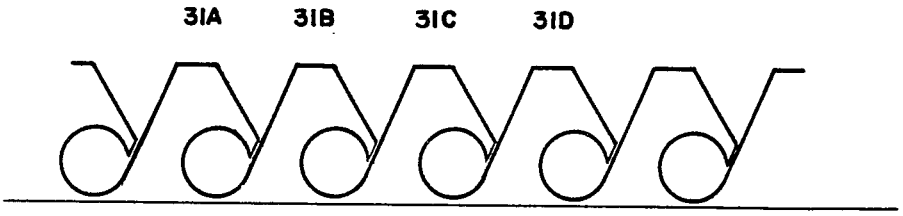
FIG. 3 is a partial plan view of one embodiment of a fastener row in accordance with the fastener profile of FIG. 1.

A fastener of the type shown in FIG. 1 may be employed in a linear array to create a fastener row 30 as shown in FIG. 3. In this embodiment, a series of tabs 31A, 31B, 31C, etc. are spaced apart at intervals corresponding to the separation of coils in a given spiral binder. For each individual tab, the corresponding backing member has been replaced by a portion of the adjacent tab. Of course, different versions of fastener strip 30 must be designed for different coil pitches.

Figure 4:
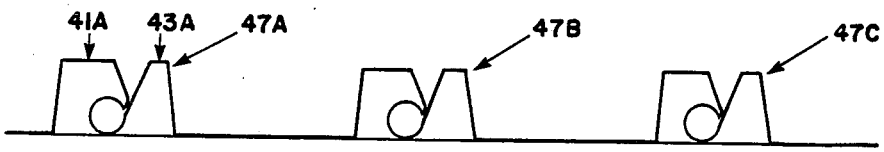
FIG. 4 is a partial plan view of an alternative embodiment of a fastener row in accordance with the fastener profile of FIG. 1.

In the embodiment shown in FIG. 4, a fastener row 40 includes a series of tab-backing member pairs, with each tab and corresponding backing member matching those shown in FIG. 1. The pairs 47*a*, 47*b*, etc. are advantageously spaced apart at intervals of one inch. This means that such pairs will not engage every coil in a given spiral binder, but instead they will engage every fifth coil for a coil pitch of five per inch, every sixth coil for a coil pitch of six per inch, etc. As almost all coil pitches may be expressed in terms of an integral number of coils per inch, a fastener row 40 may be used with almost any standard spiral binder.

Figure 5A:
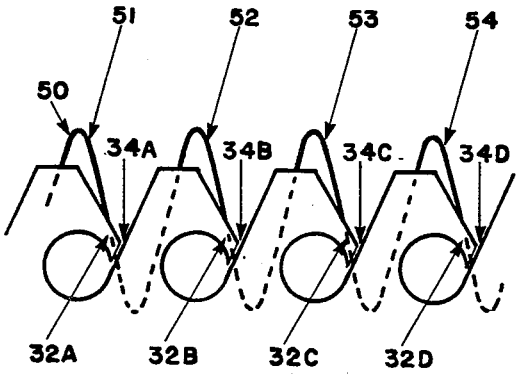
FIGS. 5A, B are partial sequential views of the capture of the fastener row of FIG. 3 by a spiral binder.
Figure 5B:
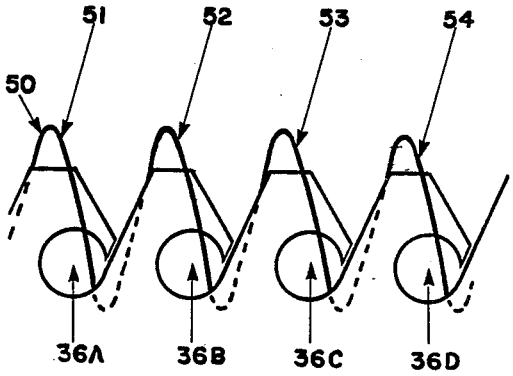

The process of attaching a fastener row of the type shown at 30 in FIG. 3 is illustrated in FIGS. 5A and 5B. Fastener row 30 is placed on the top of a spiral 50 such that the hooked regions 32A, 32B, etc. are resting over the coils 51, 52, 53, etc. (see FIG. 5A). Downward pressure on the fastener row 30 at the end causes hooked region 52A to bend as in FIG. 2, whereby the coil 51A slips through gap 34A into aperture 36A. Such pressure may also be exerted by means of a pen, pencil, or similar tool, pressed directly upon the hooked regions. Having admitted the fastener coil, the tab 31A returns to its original, undistorted state (see FIG. 5B). This effect is repeated sequentially, and the fastener row 30 becomes attached to spiral 50 in an easy, zipper-like manner. The key here, and the key to removing the fastener, is the exertion of pressure in a direction transverse to the plane of the fastener strip 30. Removal of the fastener row 30 is accomplished by the converse process of exerting upward pressure on the fastener tabs, causing sequential separation. This may be accomplished by flexing the row 30 manually. As the normal stresses exerted on sheets contained in wirebound notebooks, etc., are outward stresses in the plane of the sheets, the chance of accidental removal of a specimen bound by fastener 30 is minimal. The processes of inserting and removing a fastener row of the type shown in FIG. 4 are similar, as is the degree of protection from accidental removal.

Figure 6:
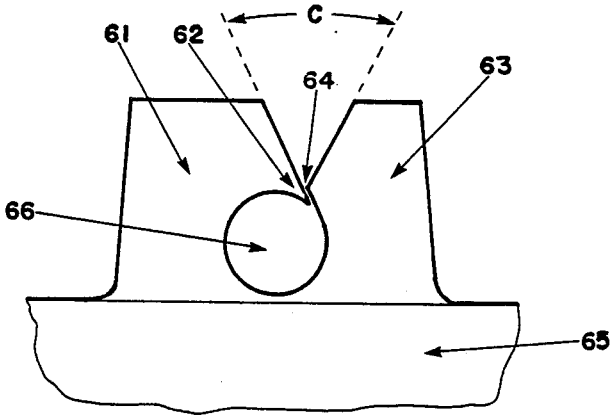
FIG. 6 is a plan view of a fastener tab and backing member in accordance with a second embodiment of the invention.

An alternative embodiment of the fastener of the invention is shown in FIG. 6. The general features are the same as those of fastener 10. The two principal differences in the fastener profiles are a smaller size of hooked region 62 as compared with hooked region 10, and a less recessed location for gap 64 as compared with that of gap 14. With reference to FIG. 1, it is preferable to locate the gap to one side or the other of the central outer point 18 of the aperture perimeter, to minimize the danger of release due to a pull in direction A. These differences facilitate the insertion and removal of the coil to and from aperture 66, but result in a somewhat lower degree of protection from accidental removal of a coil from fastener 60.

Figure 7:
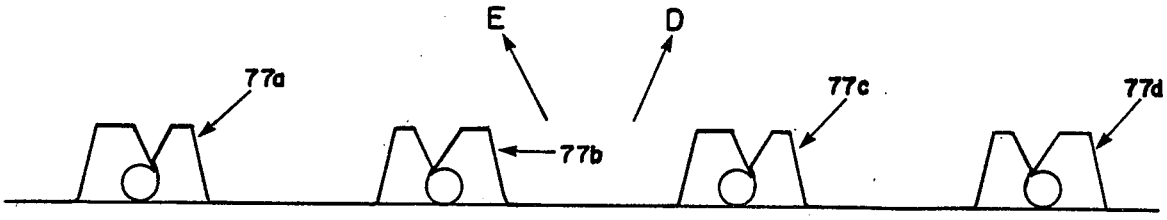
FIG. 7 is a partial plan view of a fastener row in accordance with the fastener profile of FIG. 6.

Fastener row 70, similarly to fastener row 40, includes a series of tab-backing member pairs 77*a*, 77*b*, etc., spaced at a standard interval of 1 inch (see FIG. 7).

The individual tab profiles in fastener row 70 conform to those of fastener 60. Unlike fastener row 40, the relative positions of the tab and corresponding backing member alternate from pair to pair. Thus, in pairs *77a* and *77c*, the backing member is to the right of the tab, while the converse is true of pairs *77b* and *77d*. This configuration is especially useful in conjunction with a fastener profile of type 60, in that it decreases the likelihood of removal of fastener row 70 due to an outward, angled pull on the strip. A pull in direction D would tend to release coils from pairs *77a* and *77c*, but this is prevented by the resistance of the tabs of pairs *77b* and *77d* to release the coils from the apertures thereof. A force in direction E will not dislodge fastener row 70 for similar reasons.

Figure 8:
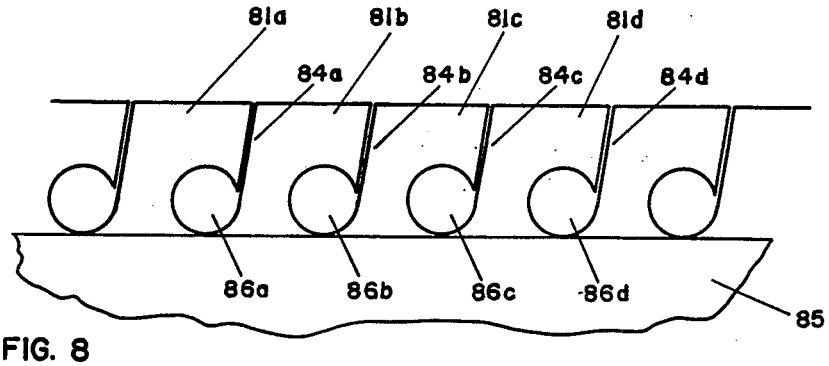
FIG. 8 is a partial plan view of a fastener row in accordance with a third fastener tab-backing member embodiment.

A comparison of the profiles of fasteners 10 and 60 reveals two characterizing parameters to be considered in designing such fasteners. Gap 14 is longer than gap 64, and hence offers somewhat more resistance to the passage of a coil when tab 11 is undistorted. The angles B and C formed by the outer profiles of the respective tabs and backing members are both approximately 60°. The presence of a V-notch or similar opening in the outer profiles, while not an indispensible aspect of the invention, facilitates the processes of admitting and releasing a coil through the gap. FIG. 8 shows a fastener row 80 in which such a notch is not present. It has been discovered that 60° is a preferred angle for such a notch, for reasons of proper operation of the fasteners and ease of fabrication.

A common, preferred feature of fasteners 10 and 60 is the tangential orientation of gaps 14 and 64 with respect to the perimeters of apertures 16 and 66, respectively. This orientation minimizes the likelihood of accidental escape of a wire coil in response to an outward force, which would be radial or secantial in direction.

Figure 9:
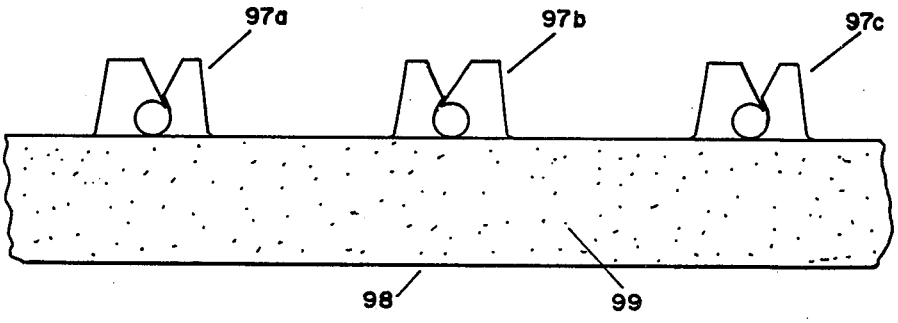
FIG. 9 is a partial plan view of a fastener strip for attaching specimens to a spiral binder, in accordance with one format of the fastener of the invention.

The fastener of the invention may be utilized in a number of forms, including those of the following illustrative examples. FIG. 9 shows a fastener strip 90 conforming to fastener row 70, which may be used to attach desired specimens of any medium suitable to carriage in a wire binder. The strip 90 includes tab-backing member pairs 97A, 97B, etc., attached to a marginal strip 98 which serves as a base; the entire strip 90 is advantageously cut from a single sheet of material. Marginal strip 98 may be coated with an adhesive 99 on one or both of its sides, so that fastener strip 80 may be used to bind one or two specimens of a desired medium. Fastener strip 90 may be sold alone, or with a preattached medium.

Figure 10:
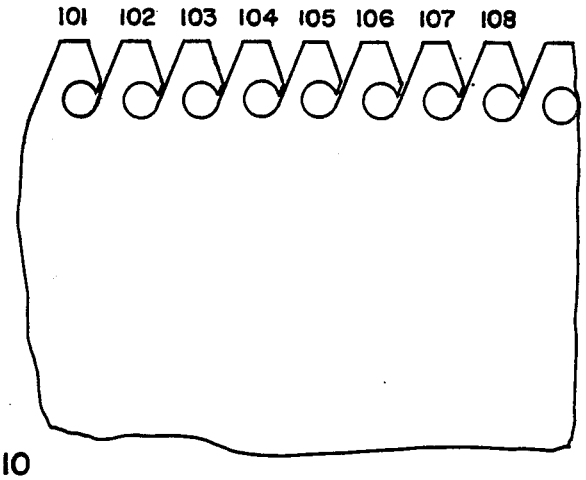
FIG. 10 is a partial plan view of a fastener row perforated in a medium to be carried by a spiral binder, in accordance with a second format of the fastener of the invention.

The fastener of the invention, in the embodiment of FIG. 3, is shown in a second format in FIG. 10. Given a sheet of paper or other specimen compatible with a spiral binder, a fastener 100 may be achieved by perforating the edge of the specimen so as to create a suitable fastener profile. If the selected medium is insufficiently strong to guarantee firm attachment to the spiral binder, the tabs 101, 102, 103, etc. may be given added support by coating them with a reinforcing material, typically a plastic. In one application of this second format, a fastener row in accordance with the invention may be included in a divider sheet, to be used as an indexing device in wire bound notebooks. Similarly, a notebook filled with sheets perforated as in FIG. 10 may be easily edited, as transposition of sheets and addition of new material present little problem.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. A member for removable attachment to a binder comprising a tab and a backing spaced therefrom;

said tab having a hook which defines an aperture with said backing and is bendable out of the plane of the member for receiving and engaging the binder;

said backing having an edge that extends diagonally tangential from the aperture and defines an open gap terminating in an open notch at the outer edge with respect to said tab for the passage of the binder into said aperture.

2. The member of claim 1 wherein said tab and backing are essentially flat and attachable to a base.

3. The member of claim 2 wherein said tab is not easily distortible within said plane, but is transversely flexible.

4. The member of claim 3 wherein the gap between said tab and said backing has a width when said tab is undistorted which is less than the thickness of a coil of a spiral binder.

5. The member of claim 1 wherein said tab and said backing are comrpised of a plastics material.

6. The member of claim 1 wherein said aperture is essentially circular, with a diameter of about 0.125 inch.

7. The member of claim 1 wherein the hook has an edge facing the backing which is shorter than the minimum dimension of said aperture.

8. The member of claim 1 wherein the hook extends to a tip with an included angle of less than 45°.

9. The member of claim 21 wherein said tab and said backing have edges opposite points of attachment to a base which define a V-notch terminating at said gap.

10. The member of claim 1 forming each of a series of tab-backing pairs attached to a base in a linear array.

11. The member of claim 10 wherein said tab-backing pairs are spaced on said base at intervals of about 1 inch.

12. The member of claim 10 wherein the relative position of the tab and backing in each of said tab-backing pairs alternates from pair to pair.

13. The member of claim 10 wherein said base comprises a marginal strip suitable for binding a specimen to be attached to a wire binder.

14. The member of claim 10 wherein said marginal strip is coated with an adhesive.

15. The member of claim 10 wherein said base comprises a specimen suitable for carriage in a wire binder, in one edge of which said tabs and backing members are perforated.

16. The member of claim 11 forming one of a series of tabs attached to a base in a linear array, such that a portion of each tab remote from its aperture comprises a backing for an adjacent tab.

17. The member of claim 16 wherein tabs are spaced at intervals corresponding to the separation of coils in a given coil pitch.

18. The member of claim 16 wherein said base comprises a marginal strip suitable for binding a specimen to be attached to a wire binder.

19. The member of claim 18 wherein said marginal strip is coated with an adhesive.

20. The member of claim 16 wherein said base comprises a specimen suitable for carriage in a wire binder, in one edge of which said tabs and backing members are perforated.

21. The member of claim 1 wherein said hook is in the form of a span which has its minimum width at an intermediate position between the region facing the edge of said backing and the remainder of said tab.

* * * * *